United States Patent [19]

Rieger

[11] 4,058,944

[45] Nov. 22, 1977

[54] BUILDING STRUCTURE WALL

[75] Inventor: Walter Rieger, Gmunden, Austria

[73] Assignee: Bauhutte Leitl-Werke Rieger-Anlagentechnik GmbH, Linz, Austria

[21] Appl. No.: 703,224

[22] Filed: July 7, 1976

[30] Foreign Application Priority Data

July 7, 1975 Austria ..... 5199/75

[51] Int. Cl.[2] ..... E04H 1/00

[52] U.S. Cl. ..... 52/235; 52/513; 52/586

[58] Field of Search ..... 52/235, 496, 585, 586, 52/227, 508, 509, 513

[56] References Cited

U.S. PATENT DOCUMENTS

| | | | |
|---|---|---|---|
| 2,881,613 | 4/1959 | Taylor et al. | 52/496 X |
| 3,686,817 | 8/1972 | Adams | 52/586 |
| 3,849,954 | 11/1974 | Sugita | 52/235 |

FOREIGN PATENT DOCUMENTS

| | | | |
|---|---|---|---|
| 1,277,541 | 9/1968 | Germany | 52/235 |
| 2,355,314 | 5/1974 | Germany | 52/235 |

*Primary Examiner*—Price C. Faw, Jr.
*Assistant Examiner*—Carl D. Friedman
*Attorney, Agent, or Firm*—Burns, Doane, Swecker & Mathis

[57] ABSTRACT

A building structure wall, in particular a facade construction, is made of plate-like construction elements arranged beside and above one another and secured to elongate members, and recesses being provided in the construction elements, and closing elements surrounding the elongate members are inserted in the recesses and boltable with at least one of the plate-like construction elements.

17 Claims, 10 Drawing Figures

BUILDING STRUCTURE WALL

The invention relates to a building structure wall, in particular a facade construction, made of plate-like e.g. ceramic construction elements arranged beside and above one another.

Facade-revetments for carcase walls of buildings under construction are known, in which plate-like construction elements, such as plates of fibrous cement, are secured to support or sub-constructions, respectively. Such support constructions consist either of wood lath trestles secured to the carcase wall or they may be light metal constructions in which light metal section rails are secured to the carcase wall by means of dowels. The facade plates are secured to the wood lath trestles or to the light metal constructions, respectively, by means of screws, or they are hung in. The plate-like construction elements forming the real facade are not selfsupporting, but are supported by the sub-construction. Facade constructions of this kind are complicated and their setting up requires much work, since each individual plate-like construction element must be fixedly connected with the sub-construction. The great number of dowels results in a number of weak points. Furthermore, it is difficult to obtain a smooth outer facade without grinding, when the carcase wall is uneven. The precise adaptation of the plate-like construction elements is a complicated and time-consuming job.

It is furthermore known to anchor construction elements, e.g. for setting up a parting wall, on horizontal or vertical wires, the construction elements having tongue and groove connections and the wires lying in the grooves. The wires are put into the wall during the setting up thereof, which also means a lot of work and high costs.

The invention aims at preventing the above described disadvantages and has as its object to create a building structure wall of plate-like construction elements which is suited as a facade to be applied in a pre-determined distance from a carcase wall as well as for making parting walls; which preferably is self-supporting, i.e. in which a supporting connection with the carcase wall and thus the use of a plurality of joining places and elements, such as dowels, is no longer required. It is a special object of the invention to tension the wire anchoring over the entire height or width of the building structure wall at first and then to be able to put the construction elements where they belong without threading from above and to bolt them.

The invention, with which this object is achieved, with a building structure wall, in particular a facade construction of plate-like, e.g. ceramic construction elements arranged beside and above one another and secured to rods or tensioned ropes, respectively, consists in that the construction elements have recesses, into which recesses closing elements surrounding the rod or rope, respectively, and boltable with at least one of the construction elements, is inserted.

Advantageously, the rods or ropes, respectively, are vertically arranged and extend over the entire height of the building structure wall or the facade, respectively. They can be arranged inside or outside of the recesses of the construction elements.

For forming a facade at a distance from a carcase wall, suitably the rods or ropes are arranged at a predetermined distance from the carcase wall and held by hook-shaped fastening elements.

According to an advantageous embodiment of the invention, the plate-like construction elements have complementary, in particular half-round recesses at their abutting ends, into which a U-shaped closing element is inserted, a cam provided on one recess protruding between the legs of the U-shaped closing element and fixing it in its position.

An other embodiment consists in that the plate-like construction elements, at one side thereof, are provided with recesses having a dovetail-shaped cross-section, and a U-shaped closing element surrounding the rod or rope, respectively, is inserted with one leg into the recess, catch-like projections on the recess fixing the closing element in its position.

A further advantageous embodiment consists in that the plate-like construction elements have a recess of dovetail-shaped cross-section on one side, into which recess a closing element having dovetail-shaped and preferably resilient legs is inserted, wherein the rod or rope, respectively, surrounded by the closing element is arranged outside the recess.

Herein the recesses of the plate-like construction elements, with respect to their height extension, are only provided in the upper and lower part, so that always an upper and a lower part of a recess complement each other when the construction elements are arranged one above the other, and that between two construction elements arranged one above the other a closing element is insertable which has a longitudinal extension $h$ somewhat exceeding the sum of the depths $t_1$ and $t_2$ of complementary recesses, so that a joint of a pre-determined width is created between the construction elements arranged one above the other.

The building structure wall according to the invention can also be formed with corner elements, wherein a corner element is provided with a recess of substantially circular cross-section for accommodating a U-shaped closing element enclosing a rope, which closing element is fixed in its position by a cam of the recess protruding between its legs.

The invention shall now be described in a number of embodiments by way of example only and with reference to the accompanying drawings, wherein FIG. 1 is a horizontal section through a building structure wall acting as a facade and secured to a carcase wall, in which also the corner formation is illustrated.

Figure 4:
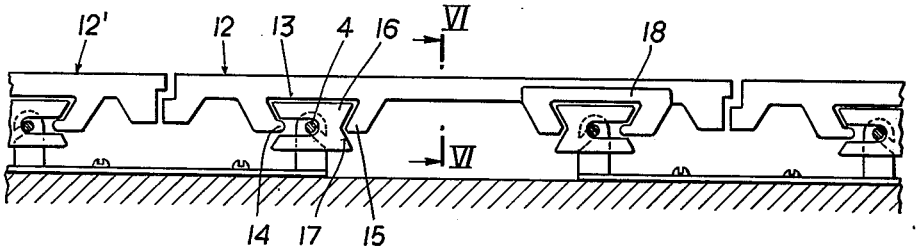
Figure 5:
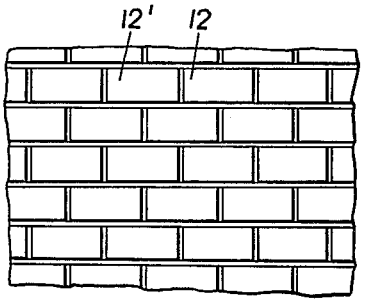
Figure 6:
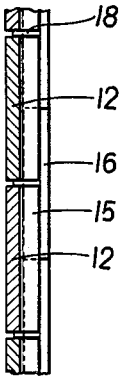

In FIGS. 4 to 6 a modified embodiment is shown, FIG. 4 being a horizontal section, FIG. 5 a view on a smaller scale and FIG. 6 a section along line VI—VI of FIG. 4.

Figure 7:
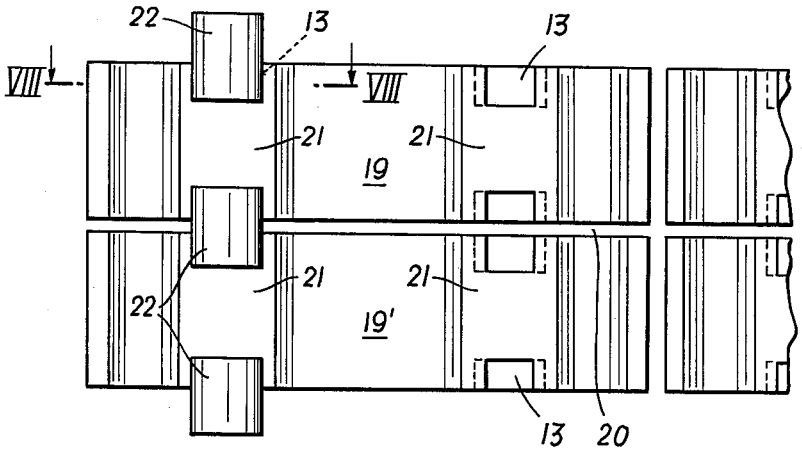
Figure 8:
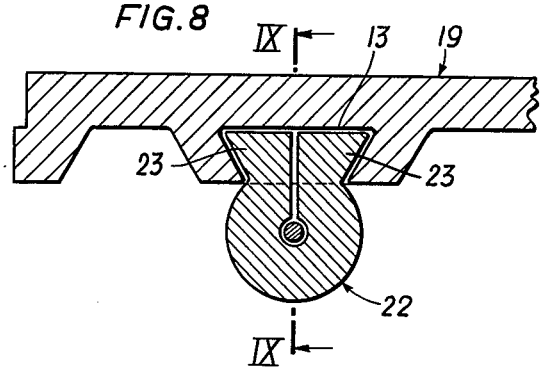

FIG. 7 is an inner view of a further modified embodiment of a facade construction, and FIG. 8 is a horizontal section along line VIII—VIII of FIG. 7.

Figure 9:
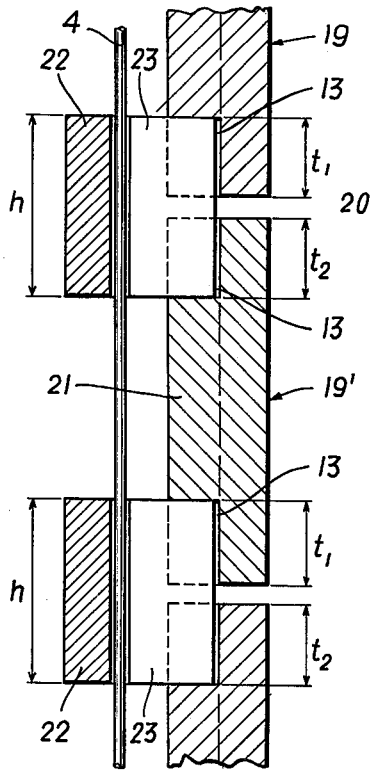

FIG. 9 is a section along line IX—IX of FIG. 8, and

Figure 10:
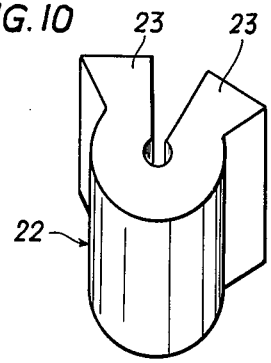

FIG. 10 is an illustration of the closing element.

Figure 1:
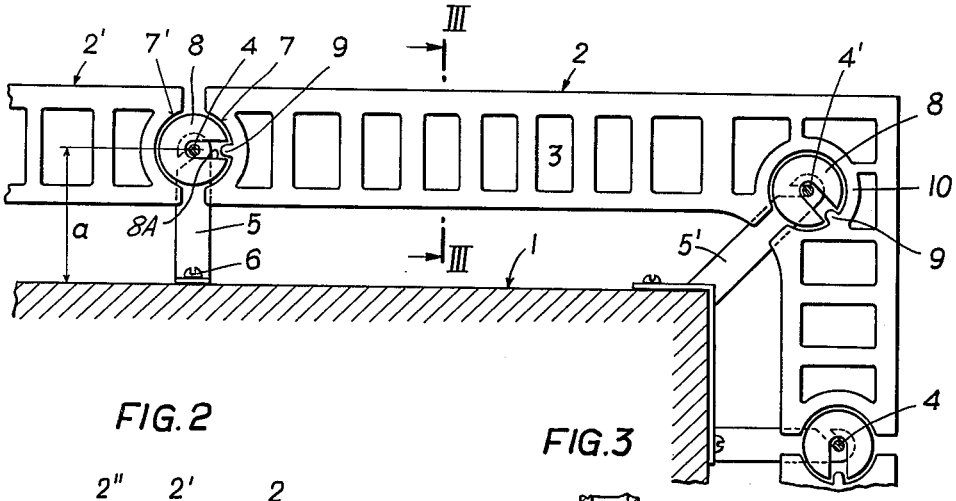
Figure 2:
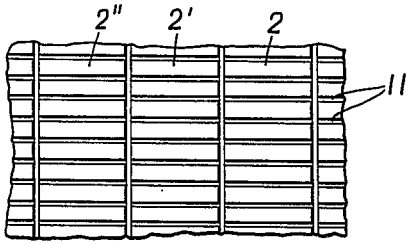
FIG. 2 is a pertaining view, but on a smaller scale.
Figure 3:
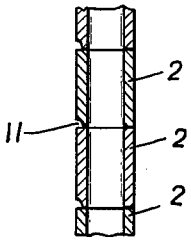
FIG. 3 is a section along line III—III of FIG. 1.

In FIG. 1, a carcase wall is denoted with 1, on which a facade revetment is arranged at a distance $a$ and consisting of plate-like elements 2. The construction elements consist of ceramic plates having hollow spaces or holes 3, which ceramic plates are arranged in rows one beside the other or one above the other. At a pre-determined distance from the carcase wall 1, ropes 4 are vertically tensioned, i.e. between the base and the roof construction. Hook-shaped holding means 5 are secured to the carcase wall by means of dowels 6, the hook surrounding the rope without form-lock, i.e. it merely holds the rope, but does not carry it. The abutting ends of two plate-like construction elements 2, 2' are provided with complementary half-round-shaped recesses 7, 7', into which recess a U-shaped closing element 8 following the outer contour of the circular recess and surrounding the rope 4 is insertable. The legs of the U-shaped holding element define a slot 8A. A cam 9 at the base of the recess 7 protrudes between the legs of the U-shaped holding element 8 and fixes it in its position. The corner part of the construction element 2 has a recess 10 of substantially circular cross-section, into which recess a closing element 8 surrounding the corner rope 4' is inserted in the same manner. Here, too, an arresting cam 9 is provided which protrudes between the legs of the closing element 8. The corner rope 4' is additionally secured against yielding by means of a holding hook 5'. From FIG. 2 it can be seen that the construction elements 2, 2', 2'' are laid without being offset relative to each other, i.e. with vertically continuously abutting joints. As can be seen from FIG. 3, the construction elements are put on top of one another to be pressure-proof. The outer view of the lower parts of the elements shows grooves 11.

In the embodiment according to FIGS. 4 to 6, plate-like construction elements 12, 12' are provided which are arranged beside and above one another. On the outside of the carcase wall, again, ropes 4 are vertically tensioned holding the plate-like construction elements 12, 12' forming the building structure.

In the embodiment illustrated, the plate-like construction elements have recesses 13 on their inside, which recesses 13 have a dovetail-shaped cross-section and are provided with catch-like projections 14, 15. The closed elements 16 surrounding the ropes are again U-shaped, the shape of the legs following the contour of the dovetail-shaped recess 13.

After insertion of the closing elements, the catch 14 projects between the legs of the closing element 16 and the catch 15 projects into a notch 17. The plate-like construction elements 12, 12' according to FIG. 4 can also be laid with equal joints as in FIG. 2, but due to their partition, i.e. the equal axis distance, they can also be arranged with their joints offset, as can be seen in FIG. 5.

Pressure-proof inserts 18 can be inserted between the horizontal rows of the elements 12, 12'. The construction is selfsupporting.

In the embodiment according to FIGS. 7 to 10, plate-like construction elements 19, 19' having recesses 13 of dovetail-shaped cross-section — as shown in FIG. 4 — are arranged above one another in a manner that a horizontal joint 20 of a certain width is formed between the elements 19 arranged one above the other.

For this purpose the dovetail-shaped recess 13 extends only to a certain depth $t_1$ in the lower part and to a certain depth $t_2$ in the upper part. In the middle part, denoted with 21, of the construction elements 19 there is no recess. Before an upper row 19 follows upon a lower row of plate-like construction elements 19', there is always a closing element 22 inserted into the upper part of a dovetail-shaped recess 13, the height $h$ of which closing element is somewhat longer than the sum of $t_1$ and $t_2$, the difference $h - (t_1$ and $t_2)$ corresponding to the width of the joint 20.

As can be seen from FIG. 9, the closing element 22 can be formed with resilient legs 23, thus providing an additional friction lock.

Although the preferred embodiment of the invention is illustrated in the above description and in the drawings as having vertically tensioned ropes, it will be clear to those skilled in the art that the concept of the invention can also be applied with horizontally tensioned ropes or rods, respectively. For this purpose it is only necessary to rotate the construction according to FIG. 4 by 90° in clock-wise direction. In this case, however, the facade construction is no longer selfsupporting, but each individual plate-like element hangs on two horizontally tensioned ropes or rods, respectively.

The joints around the individual construction elements of the building structure according to the invention do not need to be sealed against penetrating atmospheric water, since the latter can run off freely on the inner side of the facade and the moisture can also dry up due to the natural back-ventilation.

What I claim is:

1. A facade construction for connection over the carcase wall of a building, said facade construction including a plurality of plate-like elements arranged beside and above one another in front of the carcase wall and secured to elongate members, the latter being supported by the carcase wall, and connecting means for connecting said plate-like elements to said elongate members, the improvement wherein said connecting means comprises a holding element associated with a plate-like element, said holding element including slot means sized to receive an elongate member, said slot means being outwardly open enabling said holding element to be inserted onto said elongate member at substantially any location along the latter and to be capable of longitudinal movement along said elongate member; said slot being oriented to render said holding element immovable in a direction away from the carcase wall; said plate-like element having a recess for receiving a portion of said holding element; said recess including surface means arranged to block movement of said plate-like element in a lateral direction away from the carcase wall.

2. Apparatus according to claim 1 wherein said slot and said plate-like element are mutually positioned so that a portion of said plate-like element overlies the open outer end of said slot.

3. Apparatus according to claim 1 wherein said plate-like element includes a protrusion which extends into said slot.

4. Apparatus according to claim 1 wherein said elongate members are vertically oriented and extend the entire height of the plate-like elements forming the facade.

5. Apparatus according to claim 1 wherein said recesses extend along only part of the height of said plate-like elements; the recesses in vertically adjacent ones of said plate-like elements being aligned; said holding element being greater in height than the combined height of said recesses so that said holding element abuts the top of one recess and the bottom of the other recess, with the plate-like elements being vertically spaced from one another by a predetermined amount.

6. Apparatus according to claim 1 wherein said plate-like element comprises a corner unit having mutually angled portions; said recess being located at the juncture of said portions and being substantially circular in cross-section; said holding element being substantially circular in cross-section; said plate-like element including a projection extending into said slot to prevent rotation of said holding element.

7. A building structure wall as set forth in claim 1, wherein the plate-like elements are ceramic construction elements.

8. A building structure wall as set forth in claim 1, wherein the elongate members are rods.

9. A building structure wall as set forth in claim 1, wherein the elongate members are tensioned ropes.

10. A building structure wall as set forth in claim 1, wherein the elongate members are arranged inside the recesses provided in the construction elements.

11. A building structure wall as set forth in claim 1, wherein the elongate members are arranged outside the recesses provided in the construction elements.

12. A building structure wall as set forth in claim 1, wherein the recesses are formed by complementary halves provided in abutting ends of the plate-like elements and wherein the holding elements have legs and are substantially U-shaped, a cam being provided on one complementary half protruding between the legs of the pertaining closing element and fixing the closing element in its position.

13. A building structure wall as set forth in claim 12, wherein the complementary halves of the recesses are half-round.

14. A building structure wall as set forth in claim 1, wherein the recesses are provided on one side of the plate-like elements, are of dovetail-shaped cross-section, and have catch-like projections, and wherein the holding elements have legs, are substantially U-shaped, are inserted in the recesses with one of their legs, and fixed in their positions by the catch-like projections of the dovetail-shaped recesses.

15. A building structure wall as set forth in claim 1, wherein the recesses are provided on one side of the plate-like elements and are of dovetail-shaped cross-section, and wherein the holding elements have dovetail-shaped legs, the closing elements being inserted in the recesses and the elongate members, surrounded by the holding elements being arranged outside the recesses.

16. A building structure wall as set forth in claim 15, wherein the legs of the holding elements are resilient.

17. A building structure wall as set forth in claim 1 further comprising hook-shaped fastening elements for securing the elongate members at a distance from the carcase wall.

* * * * *